United States Patent [19]

Häggedal

[11] 4,084,823

[45] Apr. 18, 1978

[54] BINGO GAME

[76] Inventor: Lars Roger Häggedal, Vårvadersgatan 21, Göteborg, Sweden, S-417 31

[21] Appl. No.: 727,425

[22] Filed: Sep. 28, 1976

[30] Foreign Application Priority Data

Oct. 1, 1975 Sweden ..... 7510986

[51] Int. Cl.[2] ..... A63F 3/06

[52] U.S. Cl. ..... 273/269; 273/139

[58] Field of Search ..... 273/135 B, 135 BC, 139

[56] References Cited

U.S. PATENT DOCUMENTS

| | | | |
|---|---|---|---|
| 972,532 | 10/1910 | Heaton | 273/139 |
| 1,867,432 | 7/1932 | Wright | 273/139 |
| 3,589,729 | 6/1971 | Girard | 273/135 B |
| 3,917,276 | 11/1975 | Greenbarg | 273/139 |

*Primary Examiner*—Richard C. Pinkham
*Assistant Examiner*—Arthur S. Rose
*Attorney, Agent, or Firm*—Witherspoon, Lane & Hargest

[57] ABSTRACT

A bingo game board comprising a playing-card section having numbers thereon selected at random and grouped in rows and a draw section containing encased and roll-up tapes carrying the concealed number which the player may draw himself and then mark off against the corresponding number on the playing-card. In order to make the draw section tamper-proof, provision is made to allow easy pulling-out of the tape to reveal the number and to prevent re-insertion of the tape to conceal the number drawn.

5 Claims, 6 Drawing Figures

BINGO GAME

BACKGROUND OF THE INVENTION

The present invention relates to an improved game board for playing the game of chance known as "bingo" wherein each one of a number of players has at his disposal an individual playing-card section on which numbers selected at random are grouped in rows and are marked off by the player as the respective numbers are drawn, until according to the rules one of the players has the particular combination on his card, i.e. "bingo".

The purpose of the present invention is to make cheating in bingo games more difficult. Although there is no evidence that cheating actually takes place in the bingo gambling business it cannot be denied that the possibilities of cheating exist. The manner in which this game has hitherto been played, provides the organizers of the game with the best possibilities of cheating at bingo as they have an opportunity to control the numbers to be drawn or most likely to be drawn during the game.

SUMMARY OF THE INVENTION

The subject invention makes it possible to eliminate the organizer's control of the development of the game. It is characteristic of the game in accordance with the invention that in addition to the playing-card section each player also has at his disposal a draw section which is provided with a number of somewhat flexible, encased and rolled-up tapes, that each tape has a free end serving as a pulling tab when the tape is pulled out and is provided with a concealed number which can be read by the player to be marked off on the playing-card section only when the greater length of the tape has been pulled out, and that each tape extends through a channel arranged to allow easy pulling-out of the tape but to prevent re-insertion thereof in order to conceal the number already drawn.

Because the player of the bingo game draws the number himself he is able to check continuously that cheating on the part of the organizers does not impair his possibilities to win, i.e. to have bingo.

The game of course in accordance with the invention offers many new possible ways of playing bingo. For instance, all participant players need not be assembled in one single room where the numbers are called out as they are drawn. Instead, a large number of players may participate in the same game while remaining in their own homes.

BRIEF DESCRIPTION OF THE DRAWINGS

The invention will be described in more detail in the following with reference to one embodiment thereof illustrated in the accompanying drawings, wherein.

DETAILED DESCRIPTION OF A PREFERRED EMBODIMENT

Figure 1:
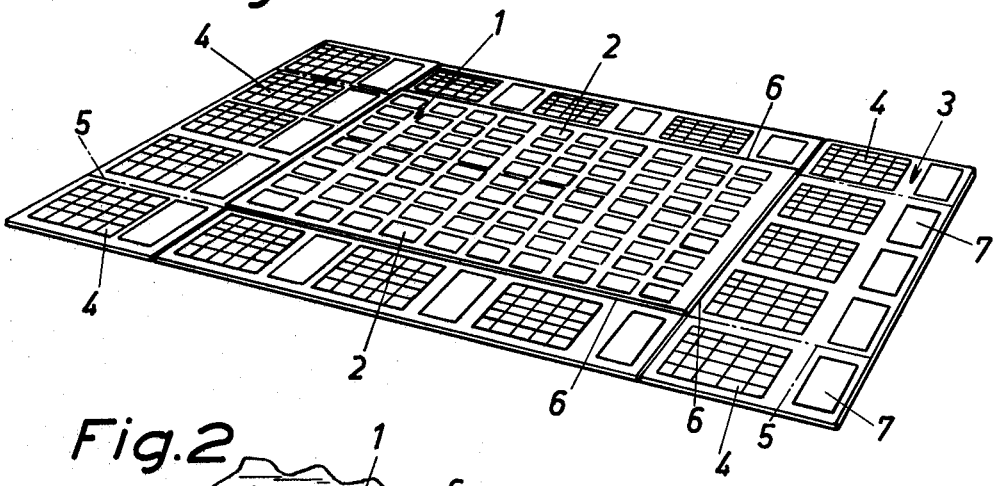
FIG. 1 is a perspective view of a bingo game board in accordance with the invention.

The bingo game board comprises a draw section 1 provided with concealed draw numbers which are arranged on number carrier means 2. Around the draw section 1 is arranged a playing-card section 3 which is interconnected with the draw section 1 and divided into playing-cards 4. The playing-cards are separated from one another by perforations 5 and from the draw section by perforations 6. The various playing-cards 4 are divided into squares, each one of which carries a number, chosen at random (see FIGS. 2 and 3). In accordance with the embodiment illustrated in the drawings, each playing-card comprises $5 \times 5 = 25$ squares. Each playing-card 4 also includes a field 7 within which may be indicated the game rules or advertisement text.

Figure 2:
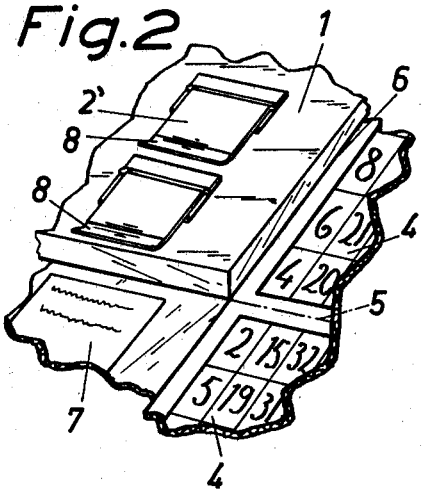
FIGS. 2 and 3 illustrate on an enlarged scale a portion of the bingo game board in accordance with FIG. 1.
Figure 3:
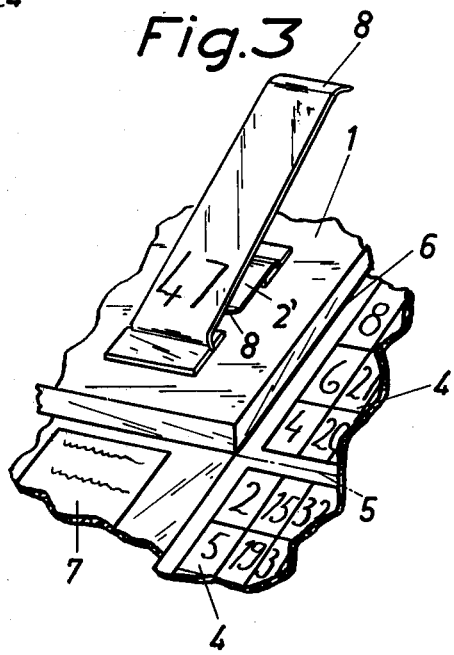
Figure 4:
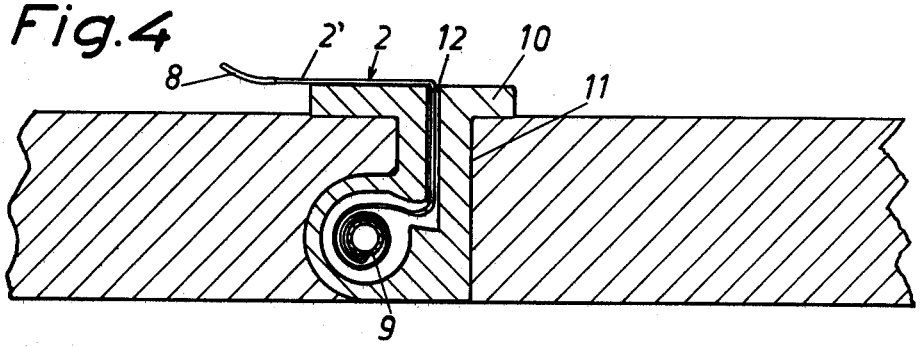
FIG. 4 illustrates on a still larger scale a cross-sectional view through a casing located in the draw section of the game board and enclosing a tape serving as a number carrier means.

As appears from FIGS. 2 and 3 the number carrier means 2 consists of a tape which is positioned in the draw section 1 in roll form with a portion 2' projecting outside. The projecting portion 2' of the tape is sealed to the draw section 1 and provided with a pulling tab 8. The draw number becomes visible only after the seal has been broken and the number carrier means pulled out as illustrated in FIG. 3. As appears from FIG. 4 the tape forming the number carrier means is rolled onto a roller 9 and enclosed in a casing 10 which in turn is provided in a channel 11 in the draw section. The casing 10 and the channel 11 are designed in accordance with the embodiment of FIG. 4 in such a manner as to make it impossible to lift the casing from the channel. The casings incorporated into the draw section should be placed at random so as not to give any indication of the number on the number carrier means. Preferably, the number carrier means is in the form of a thin tape of paper or plastics which is flexible but yet sufficiently tensile and tough not to break or be torn while it is being pulled out of the casing. The opening slot 12 of the casing 10 through which the tape 2 is pulled out is bent as an angle in order to make it impossible to reintroduce the tape into the casing 10, once it has been pulled out therefrom. A suitable thickness for the strip is 0.05 millimeters and for the opening slot 12 0.06 millimeters. The opening slot 12 allows convenient pulling-out of the tape but prevents reinsertion thereof once it has been pulled out.

Figure 5:
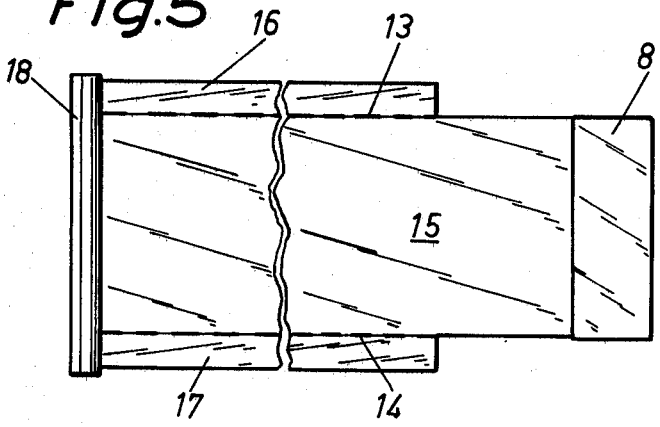
FIG. 5 illustrates the number carrier means of FIG. 4 in a view from above.
Figure 6:
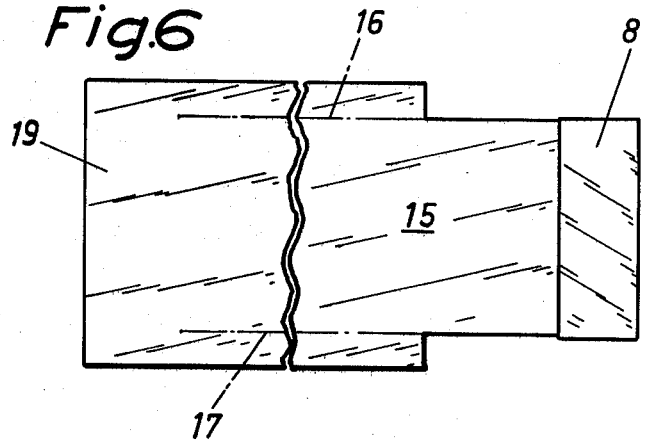
FIG. 6 is a modified embodiment of a number carrier means.

As appears from FIG. 5 the tape 2 is provided with longitudinal perforations 13, 14 separating the central portion 15 of the tape from the longitudinal marginal portions 16, 17 thereof which portions, upon pulling-out of the tape from the casing, remain inside the latter. At the inner end portion of the tape there is provided a stop edge 18 the purpose of which is to prevent the entire tape 2 from being completely pulled out of the casing 10. In accordance with the embodiment of FIG. 6 the tape is not perforated along its entire length. The inner end part 19 of the strip has no perforations and this end part 19 replaces the stop edge of the embodiment of FIG. 5.

The playing of the chance game in accordance with the invention will be described in more detail in the following. Every player has at his disposal one draw section 1 with an associated playing-card section in accordance with FIG. 1 attached thereto. The game may be played in an assembly hall where before the game begins the players pay their stake money by buying one draw section 1 each with the associated playing-card section 3 attached thereto. When buying his share in the game the player may, if he so desires, buy a smaller number of cards 4 than are shown in FIG. 1. The playing-cards that are not bought are torn away along the perforations 5 and 6. The draw section itself may for instance have a certain price and each playing-card also a certain price, and the player may vary his stakes according to the number of playing-cards he buys.

The game is played in the following manner. The game leader calls out when each player is to pull an optimal number carrier 2 out of the draw section 1. The players then indicate the number drawn in the square or squares on the playing-cards 3 carrying the number corresponding to the one drawn. When, after a number of draws which number of course is the same for all players, one of the players discovers that in accordance with the rules of the game he has made a win, i.e. has "bingo", the player must rapidly, prior to the call of the next draw, call out "bingo".

The game may be varied in many ways. For instance, each pair of rows of number carriers may have its individual colour in which case the game leader indicates that an optional number carrier of a particular colour should be pulled out. This manner of playing the game could be combined with giving the various playing-cards 4 on the playing-card section 3 different colours with the stipulation that upon call of e.g. yellow number carriers 2, only yellow cards may be marked off. In accordance with the embodiment illustrated in FIG. 1 five bingo draws could be carried out, one for each pair.

In order to reduce the manufacturing costs of the bingo game the board could be arranged in a manner permitting at least parts of it to be used again. As appears from FIG. 4 the draw section is formed with channels 11 in which the casings 10 are inserted. When the game is finished it is possible to replace all casings 10 by fresh ones. Preferably, the rolled-up tape 2 is enclosed in a non-openable casing 10 to circumvent the possibility of cheating by opening the casing 10 to check the number carried on the tape. If the casing 10 were constructed in a manner making it possible to open it or if the tape, after pulling-out, could be re-inserted into the casing with the aid of special tools there would, of course, exist a possibility to cheat.

The various playing-cards 4 of the playing-card section 3 naturally must adhere to its associated draw section 1 so as to prevent the possibility that the players swap playing-cards between them. Further, it may be advantageous to apply the numbers on the playing-cards 4 and the tapes 2 through embossing in order to eliminate the possibility that the numbers are changed.

The manufacture of the casing enclosing the number carrier means and the arrangement thereof in the draw section could be performed e.g. in the following manner.

A strip of synthetic resin is embossed with e.g. the numbers 1 to 90 in succession. Along one length-wise marginal edge of the plastic strip a border is secured, and along the opposite marginal edge is secured an edge tape. The plastic strip is then wound around the border and inserted endwise into an elongate casing having the same cross-sectional configuration as the casing 10. The edge tape is then carried out through the opening slot of the casing and the plastic strip secured on the external face of the casing. The elongate casing is cut in the transverse direction whereby 90 casings 10 are formed. In the same operation, the plastic strip is cut into the same number of tapes 2, each one carrying a number. The edge tape portion of each tape 2 thus cut forms the pulling tab. All casings 10 are then closed at their sides.

The tapes 2 are now completely enclosed in their individual casings 10 and may only be pulled out through the opening slot 12. To exclude all possibility of cheating the sealed casings 10 are introduced into a tumbler wherein they are tossed about, making it impossible to tell afterwards which numbers are concealed in the individual casings. When the casings are then positioned in a mould comprising e.g. nine rows, each comprising ten casings, the locations of the casings in the draw section will be left entirely to chance. The entire game board including the drawing section and the playing-card section is moulded, during which operation the casings are embedded into the drawing section. The entire game board may be made from the same kind of plastics and after use be melted for re-use in the manufacture of fresh game boards.

The bingo game board in accordance with the subject invention may also be adapted for nation-wise gambling in the same manner as e.g. the football pools. Suitable agents for accepting the stakes for this kind of bingo game would be those licensed for accepting football stakes, post offices, or banks. In a nationwise bingo game the winnings could be very high and thus special measures need be taken to make cheating or other irregularities impossible. For instance, coloured threads or similar members could be embedded into the game board so as to make it impossible for anyone to open the draw section to check the number on the number carriers without the drawing section being invalidated. In addition, it is possible to place a sheet of a thin metal foil in the game board to prevent revelation of the numbers on the number-carrying tapes if the board is irradiated.

The invention is not limited to the embodiment as described in the aforegoing but a number of modifications thereof are possible within the scope of the appended claims.

For instance, the entire game, i.e. the drawing section 1 as well as the playing-card section 3 may be manufactured from cheap materials and be discarded after use. This would be particularly advantageous when the game is played on a nationwide basis, in which case for obvious reasons game boards for re-use would not be practical. Instead of being located in their individual casings the tapes could be placed between two slabs forming the draw section. The free ends of the tapes would in that case be inserted through their respective slots formed in one of the slabs and forming the pulling tab.

It is also possible to embed into the game board metal foil pieces which are arranged in patterns that are particular to each game. This is advantageous particularly in the case of nationwide bingo games as it is then important to be able to check that the bingo game boards sold have an appearance after participation in the game that agrees with the one before the game. With the aid of irradiation equipment it is possible to check that the patterns of the metal foil pieces are the same both before and after participation in the game and thus detect if someone has tampered with the game board.

What I claim is:

1. An improved game for playing the game of chance known as "bingo", comprising an individual playing-card section for each one of a number of players, said section having a plurality of numbers, grouped in rows and marked off by the players as the respective numbers are drawn, until according to the rules, one of the players has the particular combination, i.e. "bingo", the improvement comprising a draw section for each player in addition to said playing-card section, said draw section being provided with a plurality of flexible, encased and rolled-up tapes, a free end on each tape serving as a pulling tab for pulling said tape out, a concealed number provided on each one of said tapes, whereby said number may be read for subsequent marking-off on said playing-card section only after the greater length of said tape has been pulled out, and passage slots in said draw section, each tape extending through its associated slot, said slots being provided with means to allow easy pulling-out of said tape but to prevent re-insertion of said tape to conceal the number already drawn.

2. An improved game according to claim 1, comprising a board forming said draw section and said tapes located in roll form in their individual casings in said board.

3. An improved game according to claim 2, comprising a stop edge on the inner end of said tape, said edge preventing complete pulling-out of the tape from its casing.

4. An improved game according to claim 1, wherein said playing-card section comprises several playing cards, with perforations deliminating said cards from one another and from said draw section.

5. An improved game according to claim 1, comprising said numbers on said tapes and on said playing-cards being embossed.

* * * * *